United States Patent [19]

Farello et al.

[11] 4,144,954

[45] Mar. 20, 1979

[54] ELECTROMAGNETIC RAIL BRAKE FOR RAILWAY VEHICLES

[75] Inventors: Luciano Farello; Cesare Prada; Ettore Restori, all of Turin, Italy

[73] Assignee: WABCO Westinghouse, Turin, Italy

[21] Appl. No.: 836,260

[22] Filed: Sep. 23, 1977

[30] Foreign Application Priority Data

Oct. 11, 1976 [IT] Italy ..... 69441 A/76

[51] Int. Cl.[2] ..... F16D 65/34; H02K 49/10

[52] U.S. Cl. ..... 188/165

[58] Field of Search ..... 188/165; 303/3

[56] References Cited

U.S. PATENT DOCUMENTS

| | | | |
|---|---|---|---|
| 2,130,615 | 9/1938 | Crittenden | 188/165 |
| 2,153,383 | 4/1939 | Mathes | 188/165 |
| 2,564,945 | 8/1951 | Zuckerman | 188/165 |

FOREIGN PATENT DOCUMENTS

| | | | |
|---|---|---|---|
| 808159 | 11/1936 | France | 188/165 |
| 518404 | 6/1976 | U.S.S.R. | 188/165 |

*Primary Examiner*—Duane A. Reger

*Attorney, Agent, or Firm*—R. S. Visk; R. W. McIntire, Jr.

[57] ABSTRACT

An electromagnetic rail brake for railway vehicles of the type comprising an excitation coil and at least one shoe element consisting of a ferromagnetic core having its pole faces turned towards the rail whereby, when the coil is excited, the shoe element is attracted onto the top surface of the rail.

4 Claims, 7 Drawing Figures

FIG. 3
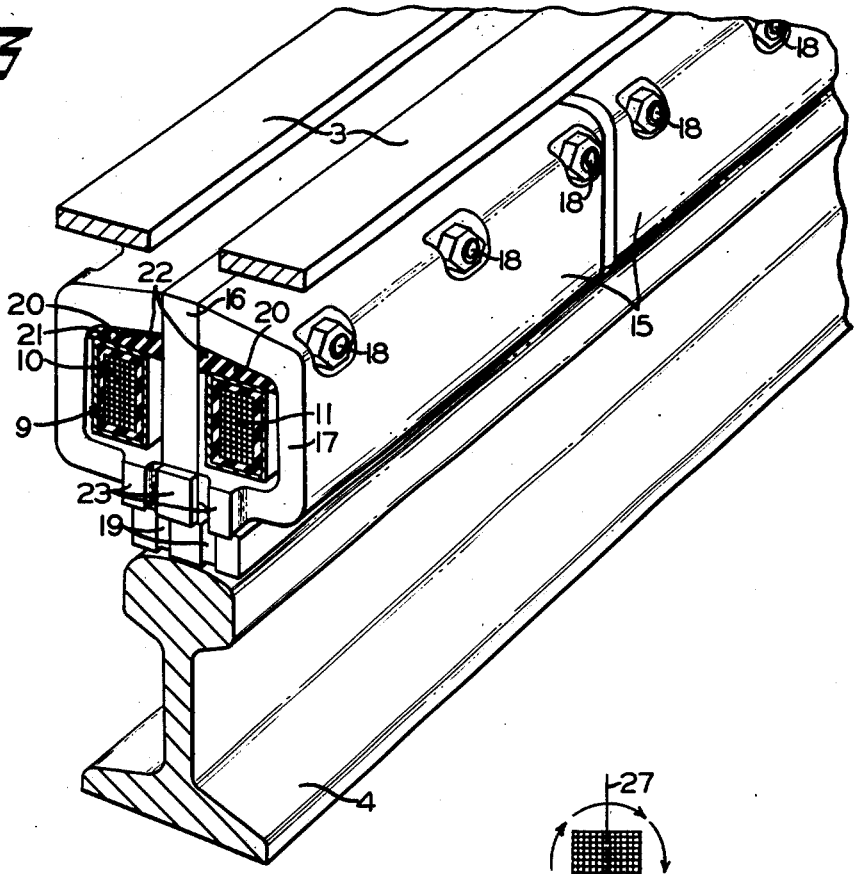
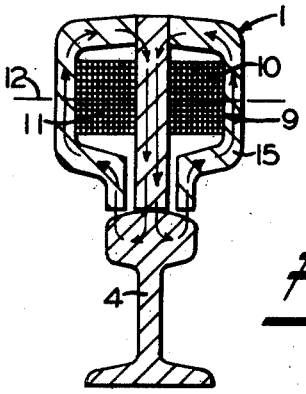
FIG. 6
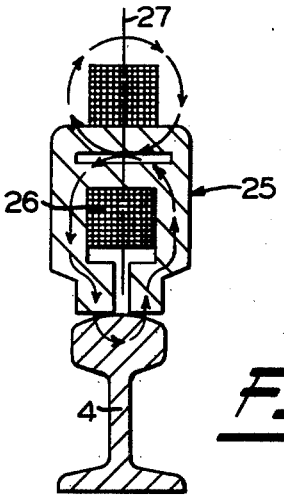
FIG. 7
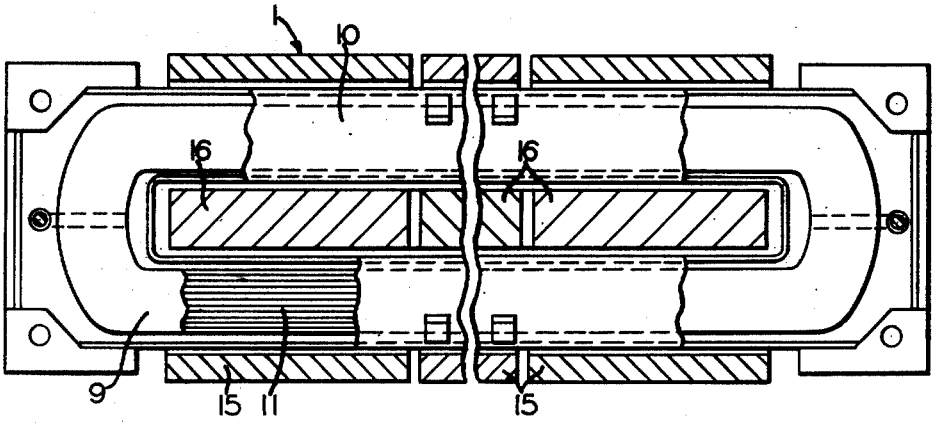
FIG 4

ELECTROMAGNETIC RAIL BRAKE FOR RAILWAY VEHICLES

BACKGROUND OF THE INVENTION

Electromagnetic brakes of this type have been known for some time. In conventional electromagnetic brakes, the coil is vertical, that is, it has a vertical median plane of symmetry that cuts through the entire peripheral surface of the coil, and the core, the section of which has the form of an inverted U, partially surrounds the lower arm of the coil and does not extend above the central opening of the coil. A disadvantage of these conventional electromagnetic brakes resides in the fact that part of the magnetic field produced by the coil is closed in the air above the rail, which results in a loss of braking power.

Another disadvantage is that the upper arm of the coil (which is the most delicate element of the brake) is exposed to external agents.

Conventional magnetic brakes comprise a series of brake shoe elements arranged in line and are usually associated with a single coil; these brake shoe elements are supported, in the rest position of the brake, by a supporting structure in such a manner that the individual shoe elements can move vertically in relation to the supporting structure so as to improve the contact of the brake shoe with the rail in case the top surface of the latter is not smooth enough. The supporting structure is normally formed by the coil casing. Each shoe element has at least one first bearing surface which, in the rest position of the brake, rests on a second bearing surface of the supporting structure. Such a supporting system of the shoe elements leads to vibrations or shocks both in the brake rest position and during braking.

SUMMARY OF THE INVENTION

The object of the present invention is to provide an electromagnetic rail brake of the type indicated above which makes it possible to utilize the full magnetic field produced by the coil and wherein the coil is fully protected against external agents.

According to the present invention, the coil is horizontal (that is, it has a horizontal median plane of symmetry which cuts through the entire peripheral surface of the coil) and its core substantially surrounds the upper part of the coil. In this manner, without resorting to a substantial increase in the dimensions of the core, an electromagnetic brake is obtained which efficiently utilizes the full magnetic field produced by the coil and wherein the coil is fully protected by the core against external agents. According to another feature of the invention, a shock-absorbing element is interposed between the first and second bearing surface. This feature makes it possible for the individual shoe elements to move freely, thus being adapted to the profile of the rail, while the shock-absorbing elements absorb the shocks and vibrations, thus making the brake more silent both in the rest position and during brake activation.

BRIEF DESCRIPTION OF THE DRAWINGS

The invention will now be described in detail with reference to the accompanying drawings, provided by way of example not limitative of the invention and wherein:

FIG. 3 is a perspective view of the brake assembly and the rail, in section and on a larger scale than FIGS. 1 and 2, taken along the line III—III of FIG. 1;

FIG. 4 is a horizontal view, in section and on substantially the same scale as FIG. 3, taken along the line IV—IV of FIG. 1;

FIG. 6 is an end sectional view corresponding to the section shown in FIG. 3 and showing the flow of magnetic flux when the brake assembly embodying the invention is applied; and FIG. 7 is an end sectional view similar to that of FIG. 6, but showing the flow of magnetic flux in a conventional magnet brake assembly when the brake is applied.

DESCRIPTION AND OPERATION

Figure 1:
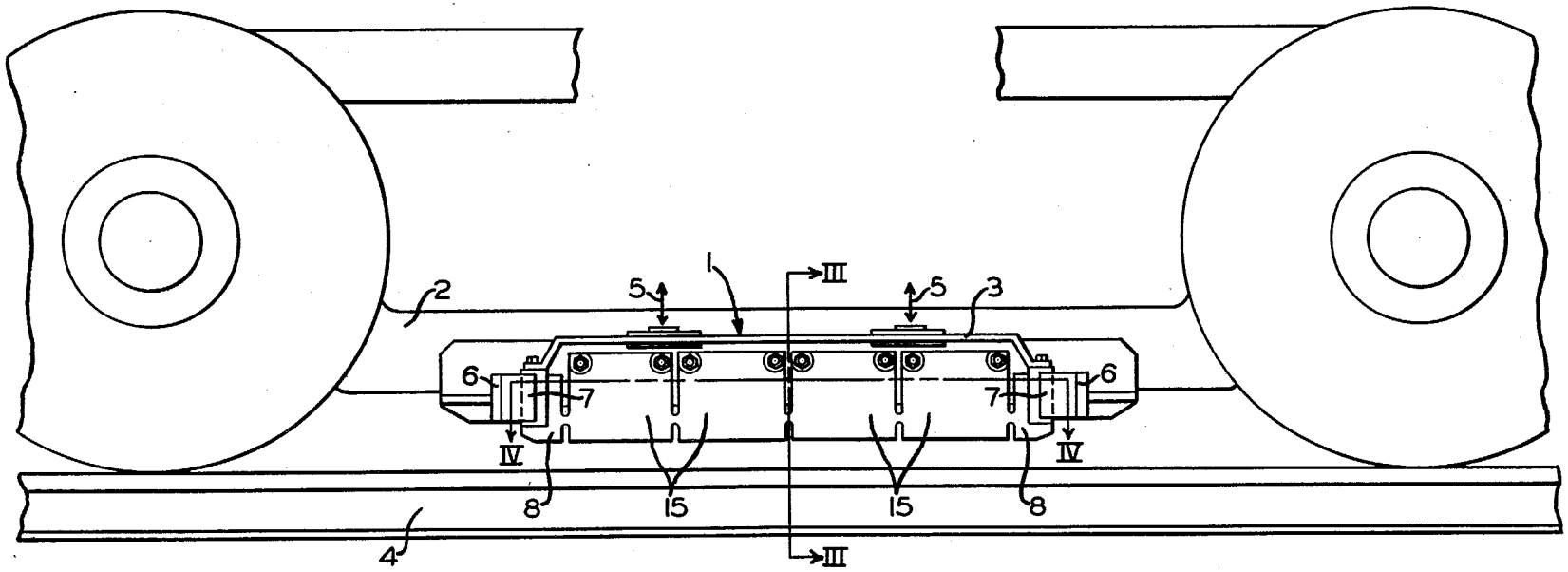
FIG. 1 is an elevational view of a portion of a railway vehicle truck provided with an electromagnetic brake apparatus according to the invention.
Figure 2:
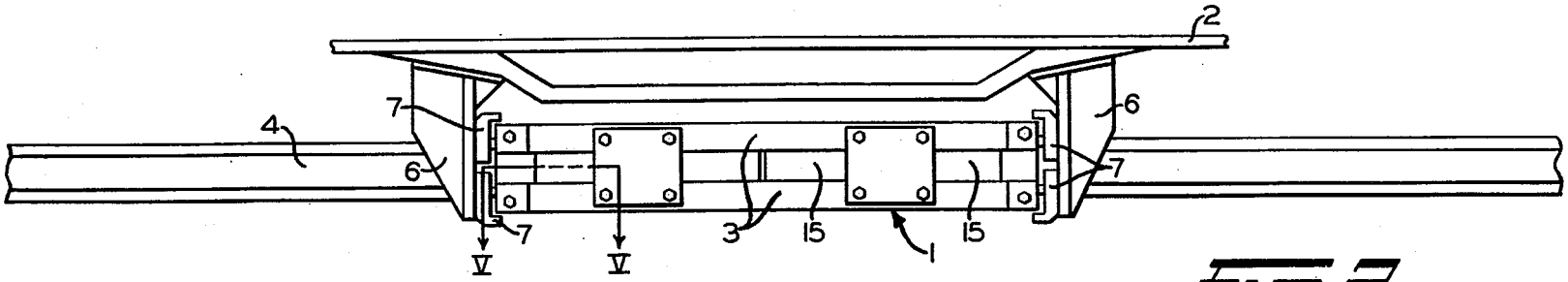
FIG. 2 is a horizontal view primarily of the electromagnetic brake assembly shown in FIG. 1.

A brake shoe assembly 1 is supported on a railway vehicle, for example, by a truck 2 of the vehicle, as best shown in FIGS. 1 and 2 of the drawings, by means of two parallel longitudinal supporting bars 3 (see FIGS. 2 and 3). The bars 3, in turn, are supported by the vehicle truck 2 by means of cylinder-piston assemblies or other mechanical and/or electrical systems (not shown) which can be extended when the brake assembly 1 is activated so as to bring said brake assembly into contact with a rail 4. This brake suspension system is not shown, but the direction of action thereof is indicated in FIG. 1 by two pairs of arrows 5. Two end brackets 6 are mounted on the vehicle truck bogie 2 and carry check pieces 7.

The supporting bars 3 carry two spaced-apart heads 8 between which is mounted an electrical excitation coil 9 of elongated shape, that is, having a greater length than its width (see FIG. 4). Coil 9 comprises two elongated side portions or arms 10 and 11 separated by a central opening and is horizontally disposed so that the median plane of symmetry 12 (see FIG. 6), which cuts through the entire peripheral surface of said coil is also horizontally disposed, or parallel to the running surface of rail 4. Coil 9 is embedded in thermosetting resins and is contained in a casing in conventional manner. The heads 8 act directly upon the check pieces 7 which, being firmly anchored to the vehicle truck 2, prevent lateral displacement of the brake assembly 1 and transmit thereto the longitudinal reactions which arise during braking. Screwed in the lower part of each head 8 is a wearing member 13 (see FIG. 5) which has the specific function of removing possible cinders or foreign elements from the rail 4 to make it smooth enough for the rest of the brake shoe assembly 1 during its action. The wearing member 13 carries a magnetic-insulation, non-ferromagnetic piece 14.

Between the two heads 8 are disposed a series of brake shoe elements 15 arranged in line and the number of which varies according to the length of each shoe element and the length of the brake shoe assembly 1. Each brake shoe element 15 is comprised of a ferromagnetic body which, viewed in cross section (see FIG. 3), is substantially E-shaped. In particular, each element 15 comprises (a) a substantially horizontal upper part (formed in the example shown by two portions which are slightly upwardly inclined towards the vertical median plane of coil 9) which extends over the upper surface of said coil, (b) a vertical central part, which extends from said upper part through the central opening of the coil with its lower end terminating below the lower limits of said coil thus forming an inner core for the coil, and (c) two side parts, each of which extends from said upper part on the side of the respective one of arms 10 and 11 of the coil and bends inwardly again below the coil and ends with a vertically downwardly extending portion parallel to, spaced-apart and terminating evenly with the lower limits of the central part, thus forming together with the upper part an outer core in the form of a box-like structure which surrounds said coil. Also, specifically, the aforementioned vertical central part of ferromagnetic body 15 and in the form of a strip 16, comprises a vertical core, while each of the aforesaid side parts and a portion of each of the aforesaid upper parts form elongated oppositely facing cheeks 17. The upper portion of the strip 16 is located between the opposite upper portions of the cheeks 17, the two cheeks 17 and the strip 16 being joined and held together by suitable means such as bolts 18, for example.

As may be seen in FIG. 3, the lower portions of strip 16 and of cheeks 17 are separated by non-ferromagnetic strips 19 consisting of a friction material. The lower face of the ferromagnetic body 15, formed by the pole faces of core 16, which cooperates with coil 9, is turned towards the rail 4.

The ferromagnetic elements or cores 16 are supported, in the release position of the brake shoe assembly 1, by the casing of coil 9 which functions as a supporting structure in such a manner that the individual elements 16 can freely move (that is, in any direction) relative to said coil. Each element 16 has two first bearing faces 20 (see FIG. 3) which are slightly upwardly inclined towards its vertical median plane. The bearing faces 20 rest on second bearing faces 21 which constitute the upper surfaces of the casing of each arm 10 and 11 of coil 9. Between the first face 20 and the second face 21, there is disposed a shock-absorbing element 22, formed by a strip consisting of an elastomeric material such as rubber, which extends over the entire length of the series of brake shoe elements 15 but is not jointed to either the first face 20 or the second face 21. Viewed in cross section, each shock-absorbing element 22 has a cuneiform profile whose upper surface is slightly upwardly inclined towards the vertical median plane of the brake shoe element 15. Thus, in the release position of brake shoe assembly 1, shoe elements 15 are hanging from the coil 9, and the shock-absorbing elements 22 absorb the shocks and vibrations, thus making the brake shoe assembly 1 more silent both in the release position and during brake application.

The adjacent opposingly disposed faces of each pair of brake shoe elements 15 make contact with each other via a substantially flat area 23 whose surface is essentially orthogonal to the longitudinal axis of the brake shoe assembly 1 and whose surface area is much smaller than the total surface area of the cross section of the brake shoe element 15 (see FIG. 3). As shown, the areas 23 protrude from each extremity of each brake shoe element 15 at the ends thereof. Each area 23 is divided into three parts, that is specifically, two lateral parts formed on the ends of the inward-bent portions of the cheeks 17, respectively, and a central part located on the lower portion of the ends of strip 16. Given the presence of the shock-absorbing elements 22 which allow the brake shoe elements 15 to have ample freedom about the casing of the coil 9, it is sufficient to limit contact between adjacent brake shoe elements 15 to the small faces of areas 23 which are sufficient for transmitting the longitudinal forces effective during brake application so as to obtain an optimum as well as a simple link between the brake shoe elements 15.

Figure 5:
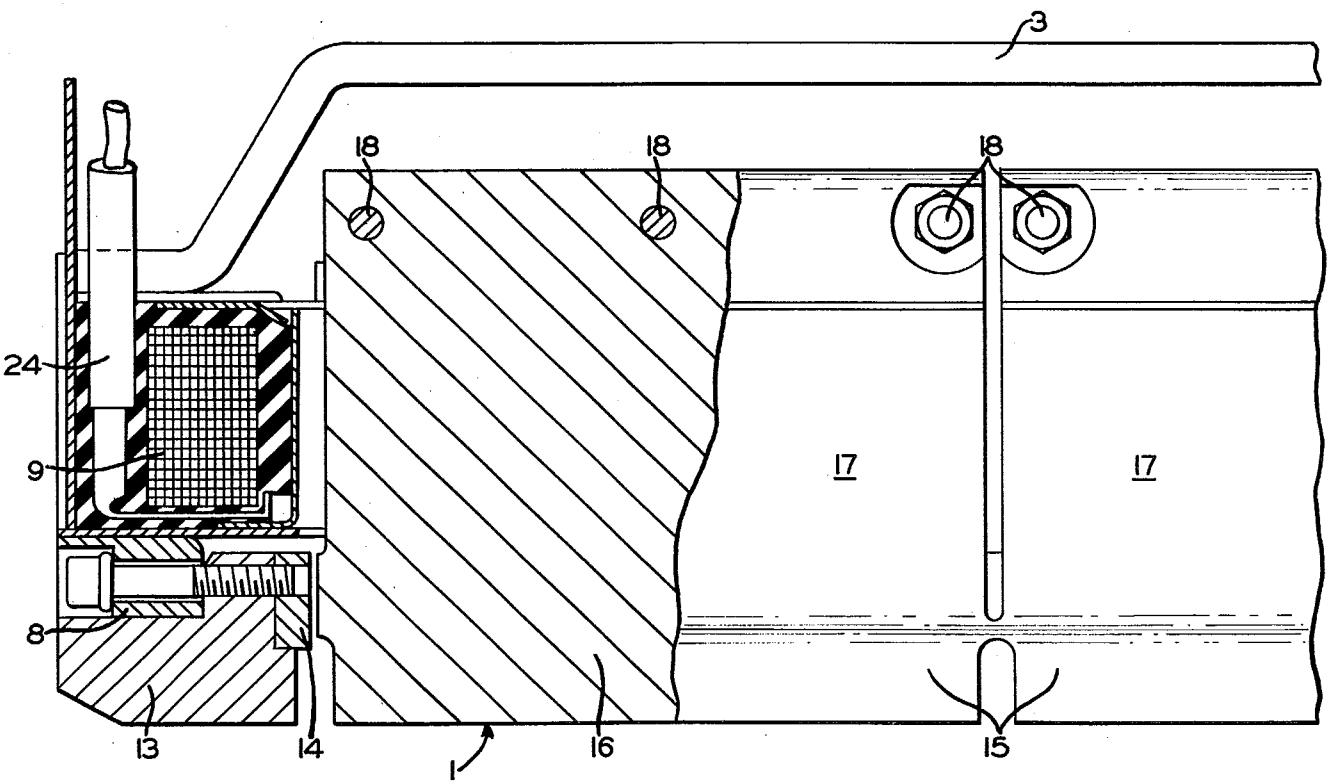
FIG. 5 is an elevational view, partly in section and on a larger scale than FIGS. 3 and 4, taken along line V—V of FIG. 2.

Coil 9 is fed in a conventional manner through a cable 24 (see FIG. 5). When the coil 9 is excited, the core formed by the ferromagnetic body of the brake shoe element 15 forms with the rail 4 a magnetic circuit (see FIG. 6) as a result of which the brake shoe element 15 is attracted downwards onto the upper face of the rail 4. The FIGS. 6 and 7 make it possible to compare the brake shoe assembly 1 of the invention with a conventional brake shoe assembly 25 which is provided with a vertical coil 26 wherein the median plane 27, which cuts through the entire peripheral surface of said coil, is vertical. In the brake shoe assembly shown in FIG. 6, all of the flux of the magnetic field produced by the coil 9 is closed through the rail 4, whereas in the convention brake shoe assembly 25 in FIG. 7, part of the flux is closed in the air above the brake shoe assembly 25. Moreover, the magnetic body 15, in the form of an E-shaped core, of the brake shoe assembly 1 in FIG. 6 fully protects the two arms 10 and 11 of said coil, whereas in the case as per FIG. 7 the upper arm of the coil 26 is disposed outside and above the inverted U-shaped core.

The invention has been described with reference to a preferred embodiment, but it goes without saying that modifications, which are conceptually and mechanically equivalent, are understood to be within the scope of the invention.

Having now described the invention, what we claim as new and desire to secure by Letters Patent, is:

1. Electromagnetic rail brake apparatus for a railway vehicle and of the type engageable with the running surface of a rail, said brake apparatus comprising:

(a) a supporting structure secured to the vehicle; and (b) a series of brake shoes arranged on said supporting structure in a line corresponding to that of the rail and in such a manner that the individual brake shoes may move freely in relation to the supporting structure, each of said brake shoes comprising:

(i) a ferromagnetic core having pole faces directed toward the rail, (ii) an excitation coil disposed horizontally in said core so as to have a horizontal median plane of symmetry cutting through the entire peripheral surface of the core and being effective, upon energization thereof, for causing movement of the brake shoes into contact with the running surface of the rail, (iii) said core having a cross-sectional area substantially in the form of an E with the open side facing downwardly and comprising a horizontal upper part extending over and in vertically spaced-apart parallel relation to the upper surface of the coil to provide a flat space running the length of the shoe, a central part secured to and extending downwardly from said upper part through a central longitudinal space of the coil to divide said flat space into two parallel portions on opposite sides of the central part and terminating below the lower limits of said coil, and two elongated parallel side parts adjacent respective outer sides of respective elongated arm portions of the coil disposed adjacent opposite sides of the central part, each of said side parts terminating at its lower end with a portion spaced apart from and coinciding with the lower limits of said central part, and (iv) a shock-absorbing element disposed in said flat space of the brake shoe between said upper part of the core and said upper surface of the coil.

2. Electromagnetic rail brake apparatus, according to claim 1, wherein the shock-absorbing element is in the form of an elongated strip conforming to said flat space and made of an elastomeric material extending over the entire length of the series of brake shoes.

3. Electromagnetic rail brake apparatus, according to claim 1, wherein the shock-absorbing strip is free of the supporting structure and the brake shoes.

4. Electromagnetic rail brake apparatus, according to claim 3, wherein a pair of shock-absorbing elements are provided and located on opposite sides of said central part of the core, respectively.

* * * * *